United States Patent [19]

Lichtenberger

[11] 4,177,441

[45] Dec. 4, 1979

[54] ELECTROMAGNETIC STRUCTURE FOR A VITAL RELAY

[75] Inventor: William J. Lichtenberger, Murrysville, Pa.

[73] Assignee: Westinghouse Air Brake Company, Swissvale, Pa.

[21] Appl. No.: 903,373

[22] Filed: May 5, 1978

[51] Int. Cl.[2] ..... H01F 7/08

[52] U.S. Cl. ..... 335/270; 335/276

[58] Field of Search ..... 335/128, 136, 177, 181, 335/270, 274, 275, 276

[56] References Cited

U.S. PATENT DOCUMENTS

| | | | |
|---|---|---|---|
| 3,259,812 | 7/1966 | O'Neil | 335/270 X |
| 3,461,411 | 8/1969 | Hufnagel | 335/270 |
| 3,958,200 | 5/1976 | Mally | 335/275 |

*Primary Examiner*—George Harris

*Attorney, Agent, or Firm*—J. B. Sotak; R. W. McIntire, Jr.

[57] ABSTRACT

An improved electromagnetic relay structure employing a multiple coil U-shaped electromagnet, a flat spring biased armature and a single piece U-shaped metallic frame for providing a floating hinge joint and a teeter point for the armature whereby the magnetic attractive pull on the armature is enhanced without diminishing the amount of armature movement.

10 Claims, 4 Drawing Figures

ELECTROMAGNETIC STRUCTURE FOR A VITAL RELAY

FIELD OF THE INVENTION

This invention relates to a novel electromagnetic relay structure and more particularly, to a U-shaped electromagnet, a unitary frame and a spring biased armature having a floating hinge joint and a teeter-totter pivot for improving the attractive action exerted on the armature when the electromagnet is energized.

BACKGROUND OF THE INVENTION

In electrical control systems, it is common practice to employ an electromagnetic relay having transfer switching contacts movable by a pivotal armature which is picked up when the electromagnet is energized and which is released when the electromagnet is deenergized. However, in many electromagnets the magnetic flux produced by the exciting coil is not efficiently used to attract the armature. In some relays, a considerable amount of the magnetic flux does not go through the armature when it is in its released position due to the fact that the permeance of the leakage flux path is not negligible in comparison to the permeance of the air gap between the faces of the armature and pole piece. Thus, the leakage flux results in decreasing the attraction or pulling force on the armature when the electromagnet is energized thereby producing a lesser amount of torque for a given amount of energizing current. It has been found that leakage flux losses may be reduced by employing a U-shaped electromagnetic core assembly. Further, to increase the attractive force acting on the armature without an increase in the energizing current, it is desirable to reduce the reluctance in the magnetic circuit, namely, in the air gap. It is quite obvious that one method of accomplishing this would be to locate the armature closer to the pole face of the electromagnetic assembly; however, in many instances this is not necessarily feasible or possible since the amount of armature movement or travel may become insufficient to properly actuate the transfer switching operation. Thus, it is desirable to improve the magnetic flux path by modifying the cooperative relationship of the electromagnetic structure without sacrificing the amount of armature movement and without adversely effecting the electrical, magnetic and mechanical operation of the relay.

OBJECTS OF THE INVENTION

Accordingly, it is an object of this invention to provide an improved electromagnetic structure for relays or the like.

A further object of this invention is to provide a novel relay structure having a U-shaped electromagnetic, a one piece frame and teeter-totter pivotal armature.

Another object of this invention is to provide a unique electromechanical device employing a U-shaped magnetic circuit having a plurality of coils mounted thereon, a flat spring biased armature and a unitary metal frame attached to the magnet circuit for pivotally supporting the armature.

Yet a further object of this invention is to provide a new and improved electromagnetic assembly having a free floating armature member.

Yet another object of this invention is to provide a new and unique electromagnetic assembly having improved electrical, magnetic and mechanical characteristics.

Still another object of this invention is to provide a refined structure for a relay having a multiple coil electromagnet, a floating hinge joint armature, and a metal frame member for holding the electromagnet and armature in operative relationship with each other.

Still a further object of this invention is to provide a novel electromagnetic device employing a U-shaped electromagnet, a spring biased armature, and a metallic frame attached to the U-shaped electromagnet and providing a floating hinge joint for the spring biased armature and providing a teeter-totter point upon which the armature rests when it is in a deenergized position.

An additional object of this invention is to provide an electromagnetic device having a U-shaped electromagnet, a spring biased armature, and a unitary metallic frame fixedly attached to the U-shaped electromagnet, the unitary metallic frame includes an apertured portion for accommodating the back side of the spring biased armature and establishing a floating hinge joint between the apertured portion and the back end of the spring biased armature, and the unitary metallic frame includes a fulcrum point about which the spring biased armature teeters to urge the back end of the spring biased armature into close proximity of the U-shaped electromagnet to minimize the air gap when the U-shaped electromagnet is deenergized.

Still an additional object of this invention is to provide a unique electromagnetic device which is economical in construction, simple in design, reliable in operation, efficient in service and durable in use.

SUMMARY OF THE INVENTION

In accordance with the present invention, there is provided an improved electromagnetic relay structure or assembly including a U-shaped electromagnet, a spring biased armature and a unitary metallic frame. The U-shaped electromagnet includes a C-shaped backstrap member of magnetic material. A pair of core pins slidably receive and separately support a pair of insulative bobbins upon which a plurality of electromagnetic coils are wound. One end of each of the core pins includes an enlarged pole piece while the other end of each of the core pins includes a reduced portion fixedly secured to the intermediate portion of the C-shaped backstrap member. The unitary metallic frame is stamped and punched from a single piece of nonmagnetic material. The frame includes a pair of upstanding legs which are securely attached to the ends of the C-shaped backstrap member. The frame includes an apertured portion formed on the back side thereof for accommodating the back end of the spring biased armature. The armature is a flat magnetic member of silicon steel having a pair of undercut slots formed in the respective sides near the end thereof. The apertured portion includes a pair of entrapping tongs which communicate with the undercut slots to form a floating hinge joint therebetween. A pair of restraining tabs project upwardly from the bottom edge of the apertured portion to maintain the armature in place during assembly. The flat magnetic armature member includes a forward extending portion overlaying a horizontal leg forming part of the unitary frame. An adjustable spring assembly including a thread stem is secured to the horizontal leg and freely extends through a hole drilled in the forward extending portion of the armature. A helical spring encircles the threaded stem, and a retaining cup is fitted onto the threaded stem and engages the upper end of the helical spring. An adjusting nut is screwed onto the free end of the threaded stem to establish the compressive force of the helical spring. An upstanding fulcrum finger is formed on the bottom of the unitary metallic frame to engage the underside of the flat armature member. The spring biased armature teeters about the upstanding fulcrum finger to urge the back end of the armature into close proximity to the pole pieces to minimize the air gap when the electromagnetic coils are deenergized and to maximize the magnetic attraction on the armature when the electromagnetic coils are energized.

DESCRIPTION OF THE DRAWINGS

The foregoing objects and other attendant features and advantages will become more clearly understood and appreciated as the subject invention is described in further detail and is considered in conjunction with the accompanying drawings wherein.

DETAILED DESCRIPTION OF THE INVENTION

Figure 2:
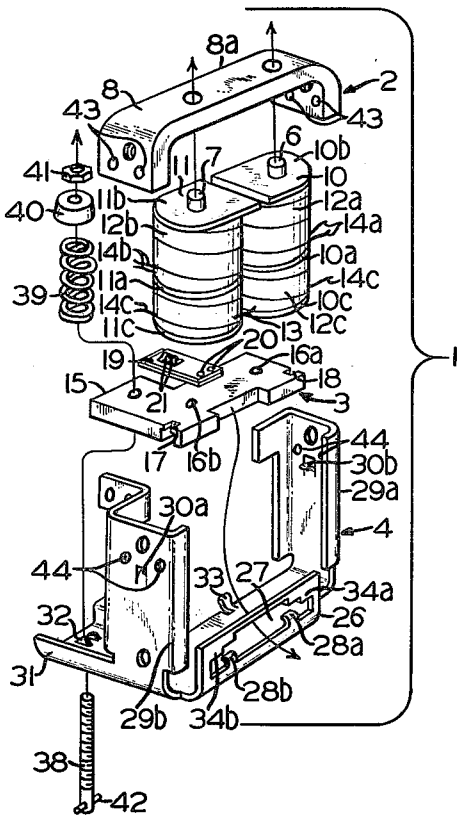
FIG. 2 is a reduced exposed view illustrating in disassembled relationship the components of the electromagnetic relay structure of the present invention as from the back side.
Figure 1:
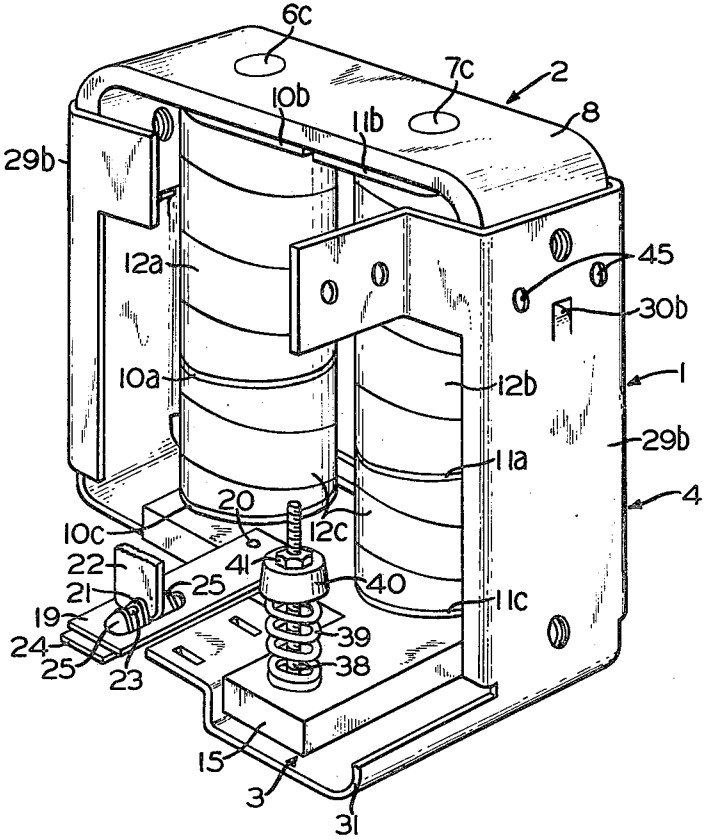
FIG. 1 is a perspective view of the frontal side of the assembled electromagnetic relay structure embodying the unique features of the present invention.

Referring now to the drawings, and in particular to FIGS. 1 and 2, there is shown the electromagnetic device or relay structure generally characterized by numeral 1 in assembled and disassembled relationship respectively. As shown, the electromagnetic structure or assembly 1 basically includes three subassemblies, namely, an electromagnet 2, an armature 3, and a frame 4.

Figure 4:
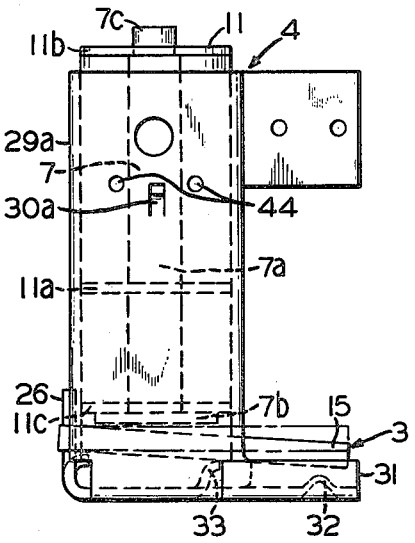
FIG. 4 is a side elevational view of the electromagnetic structure with certain parts or elements omitted for illustrative purposes.

The electromagnet 2 takes the form of a U-shaped electromagnetic subassembly having a magnetic circuit and a plurality of energizable electrical windings. The magnetic circuit includes core pins 6 and 7 and a backstrap member 8. The core pins 6 and 7 are identical in construction and are made of a low magnetic retentivity material, such as, soft iron or low content silicon steel. Each core pin includes a central cylindrical body portion, such as, shown by 7*a* in FIG. 4. As shown in FIG. 4, the cylindrical body portion has its lower end formed into an enlarged annular pole piece 7*b* and has its upper end formed into a reduced circular shank 7*c*. Similarly, the core pin 6 has a central cylindrical body, a lower annular pole piece and an upper reduced shank. The core pins 6 and 7 are adapted to receive a pair of bobbins or spools 10 and 11, respectively, which are molded or formed from a suitable thermosetting insulative material having the required electrical, thermal and mechanical characteristics. Each of the insulative bobbins 10 and 11 is divided into two sections by annular disks 10*a* and 11*a* which are disposed intermediate the upper end plates 10*b* and 11*b* and the lower end plates 10*c* and 11*c*. In practice, the intermediate annular plates 10*a* and 11*a* are located approximately two-thirds of the distance from the top plates 10*b* and 11*b*. In practice, the two bobbins are adapted to accommodate three separate energizable coils 12*a*, 12*b* and 12*c*. That is, a first individual coil 12*a* is wound on the upper two-thirds of bobbin 10 while a second individual coil 12*b* is wound on the upper two-thirds of the bobbin 10. A third individual coil 12*c* has one half of its turns wound on the lower one-third of bobbin 10 and has the other half of its turns wound on the lower one-third of bobbin 11. The two halves of coil 12*c* are electrically connected by wire or conductor 13 in series additive relation to make up a coil equal to coils 12*a* and 12*b*. Thus, the coils 12*a*, 12*b* and 12*c* can be energized by applying electrical power to their respective leads 14*a*, 14*b* and 14*c*. After the coils have been wound and covered with suitable insulation, such as, electrical tape, the bobbins 10 and 11 are slipped onto the core pins 6 and 7 until the lower insulative disks 10*c* and 11*c* bottom or engage the upper surfaces of the enlarged pole pieces. Then the upper plates 10*b* and 11*b* are arranged to have their straight edges facing each other to prevent excessive relative movement or rotation of the bobbins on the core pins. Next, the reduced shank portions 6*c* and 7*c* are fitted into a pair of spaced circular holes drilled in the bight 8*a* of the C-shaped backstrap 8 and are peened, staked or even welded to securely hold them in place. The C-shaped backstrap member 8 is formed of suitable magnetic material, such as, soft iron or low content silicon steel. Thus, the three coils, the two core pins and the bight of the backstrap form a U-shaped electromagnet 2 for the electromagnetic relay device 1.

As shown, the armature 3 is constructed of a substantially flat piece of magnetic material, such as, soft iron or silicon steel. The magnetic armature member 3 includes an apertured forward extending portion 15 which cooperates with an adjustable spring assembly to bias the armature as will be described in detail hereinafter. It will be noted in FIGS. 2 and 4 that a pair of nonmagnetic stop pins or brass stops 16*a* and 16 are fitted in suitable holes drilled in the central portion of the flat armature member 3. The brass pins 16*a* and 16*b* have heads which slightly protrude above the top surface of the flat armature 3 to provide a risidual air gap between the armature and the pole pieces. This ensures that the top of the armature will not directly contact the undersides of the pole pieces so that the residual magnetism will not cause the armature to stick to the pole pieces or fail to release immediately upon interruption of the coil current. Further, as viewed in FIG. 2, it will be noted that a pair of slots 17 and 18 are formed in the repsective sides near the back end of the armature 3. In practice, the slots 17 and 18 are relatively long with respect to the longitudinal axis of the armature member 3, and the bottom side of the armature is machined or undercut around the slots 17 and 18, the purpose of which will be described hereinafter. As shown in FIGS. 1 and 2, a contact driver connector 19 is centrally attached by rivets 20 or the like to the forward end of the armature 3. The connector 20 includes a pair of upstanding apertured tabs 21 between which is disposed a heel contact driver member 22. The driver member 22 is connected to tabs 21 by a pin 23 which passes through the holes in the apertured tabs and a hole in the end of the driver member. A resilient pin retaining plate 24 including a pair of upstanding tabs 25 communicate with the ends of the pin 23 to hold it in place.

Figure 3:
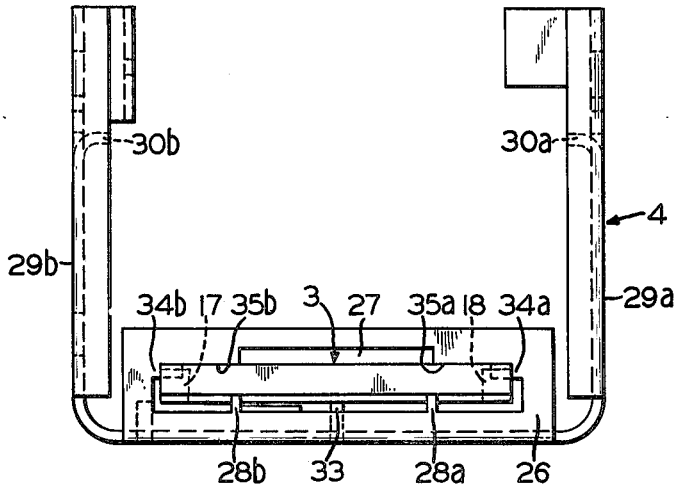
FIG. 3 is a back elevational view of the frame and armature members of the electromagnetic structure with certain parts or elements omitted for the purpose of clarity.

As shown in the drawings, the frame 4 is a unitary or one piece member formed of nonmagnetic or nonferrous metal, such as, hard brass or the like. The unitary metallic frame is stamped, bent, punched and drilled to form a substantially U-shaped configuration as shown in the drawings. In viewing FIGS. 2 and 3, it will be seen that the brass frame 4 includes an upstanding apertured wall portion 26 formed on the back end thereof. The elongated slot 27 of the apertured wall 26 includes a pair of steps or offset portions, formed at the top on each side to accommodate the back end of the armature member 3. Further, a pair of upstanding restraining tabs 28*a* and 28*b* are struck out of the wall portion 26. The sides of the frame member 4 are bent upwardly to form channel like supporting legs 29*a* and 29*b*. A pair of inwardly bent tongues 30*a* and 30*b* are struck from the supporting legs 29*a* and 29*b*, respectively. A forward extending portion 31 projects from the bottom portion of the metallic frame 4. A centrally located hole and indented portion 32 are formed near the outer extremity of the portion 31 to accommodate a thread stud member of an adjustable spring assembly as will be described presently. In viewing FIGS. 2, 3 and 4, it will be seen that a fulcrum finger or teeter tab 33 is struck upwardly from substantially the bottom of the brass frame 4.

Before the armature 3 is inserted into the slot 27 of the apertured wall portion 26, the restraining tabs 28*a* and 28*b* are bent horizontally to allow for clearance. Next, the back end of the armature is slid into the aperture 27 until the side slots 17 and 18 are in alignment with the pair of second step portions 34*a* and 34*b* of the wall portion 26. Then the back end of the armature 3 is slightly lifted to allow the steps 34*a* and 34*b* to fit into the respective side slots 17 and 18. Next, the restraining tabs 28*a* and 28*b* are bent upwardly until they nearly touch the bottom of the armature 3 so that the entrapment steps 34*a* and 34*b* will remain in the slot 17 and 18 when the assembler releases the armature. The released armature will rest on the upstanding teeter tab 33 so that the adjustable spring assembly may be placed in position. The spring assembly includes a threaded stem 38, a helical compression spring 39, a retaining cup 40 and a threaded nut 41. The threaded stem 38 includes a pin 42 press fitted into the lower end which communicates with indented portions 32 when the threaded end is inserted through the holes in frame portion 31 and armature portion 15. Next, the helical compression spring 39 is placed over the threaded end of stem 38, and the bottom end of spring 39 rests on the upper surface of armature portion 15. Then the inverted retaining cup 40 is placed over the threaded end of stem 38. The cup 40 encompasses the upper turns of the spring 39 and centers the spring relative to the threaded stem 38. Finally, the nut is screwed onto the threaded stem 38 and is properly adjusted to bias the forward extending armature portion downwardly and urges the upper surface of the back end of the armature 3 upwardly against pivotal edges 35*a* and 35*b* as viewed in the drawings. It will be appreciated that the amount of necessary compressive force exerted by the spring 39 is dependent upon the number and resiliency of the heel contacts that are actuated by the driver card 22. Now the assembled frame and armature structure may be united with the U-shaped electromagnet 2. As shown, the ends of the backstrap member 8 are placed into the respective upstanding channels or legs 29*a* and 29*b* so that the end faces engage the bent tongues 30*a* and 30*b*. With the ends of the C-shaped backstrap 8 resting on the tops of tongues 30*a* and 30*b*, the tapped holes 43 in the sides of the backstrap 8 and the drilled holes 44 in the upstanding legs 29*a* and 29 will become aligned so that the screws may be inserted into the threaded holes and tightened up to secrely hold the assemblies together in operational relationship.

Next the pick up and drop out characteristics of the electromagnetic device 1 may be adjusted by varying the compressive force of the helical spring 39. It will be appreciated that the energization of any one of the three coils 12*a*, 12*b* or 12*c* will result in the picking up of the armature member 3 and will cause the opening of the back contacts and opening of the front contacts by driver card 22. In viewing FIG. 4, it will be noted that the armature member is shown in full lines in its released or deenergized position and is shown in phantom in its picked up or energized position. When the electromagnet 2 is deenergized, the armature 3 and fulcrum 33 function as a teeter-totter with the pressure or force of the compression spring 39 urging the front end portion 15 of the armature 3 downwardly and causing the back end of the armature 3 to ride on the edges 35*a* and 35*b* of the slot 27. As shown in FIG. 4, the air gap between the upper surface of the magnetic armature 3 and the lower surface of the magnetic pole piece 7*b* is smaller at the back end than at the front end. It will be appreciated that the air gap between the pole pieces of core pin 6 corresponds to the air gap between pole piece 7 and armature 3. The small air gaps at the back end of the pole faces and armature remain substantially constant when the electromagnet becomes energized while the remaining air gap decreases as the armature 3 is pivoted about the float hinge joint and is attracted by the magnetic flux flowing through the magnetic circuit which includes the backstrap 8*a* and core pins 6 and 7. Thus, the magnetic pull on the armature is initially the greatest at the back end due to the decreased reluctance and becomes evenly distributed over the entire area of the pole faces of the core pins 6 and 7 when the armature reaches its picked up position since the entire air gap becomes equal to the smallest dimension as shown by the phantom lines in FIG. 4. Conversely, when the electromagnet 2 becomes deenergized, the forward end of the armature tends to drop away from the pole faces when the remanent or residue magnetic flux retains the back end of the armature 3 so that its upper surface remains engaged with the pivotal edge 35*a* and 35*b*. When the intermediate under surface engages and teeters about fulcrum point 33, the compressive force of the spring 39 keeps the back end of the armature in contact with the edges 35*a* and 35*b* to maintain the small air gap at the back end. Thus, the magnetic attractive force on the armature 3 is maximized while there is no sacrafice in the amount of armature movement.

It will be appreciated that the subject invention finds particular utility in vital electromagnetic relays, it is readily understood that the presently described electromagnetic device may be employed in other electromechanical, electropneumatic and electrohydraulic structures, such as, valves and the like. Further, it is understood that regardless of the manner in which the invention is used, it is apparent that various changes and modifications may be made by persons skilled in the art without departing from the spirit and scope of this invention. For example, the number of coils may be varied so that a single, dual or a plurality of coils may be employed as desired dependent upon the external circuitry and the like. In addition, the threaded stem 38 may be provided with a thin square head or the like which may be soldered or welded to the underside of the frame portion 31 rather than being provided with the pin 42. Further, it is understood that all variations, alterations and equivalent falling within the bounds of the present invention are herein meant to be included in the appended claims.

Having thus described the invention, what I claim as new and desire to secure by Letters Patent is:

1. An electromagnetic device comprising, a U-shaped electromagnet, a spring biased armature, and a unitary metallic frame fixedly attached to said U-shaped electromagnet, said unitary metallic frame includes an apertured portion for accommodating the back side of said spring biased armature and establishing a floating hinge joint between said apertured portion and said back end of said spring biased armature, and said unitary metallic frame includes a fulcrum point about which said spring biased armature teeters to urge the back end of said spring biased armature into close proximity of said U-shaped electromagnet to minimize the air gap when the said U-shaped electromagnet is deenergized.

2. The electromagnetic device as defined in claim 1, wherein said U-shaped electromagnet includes a pair of core members interconnected by a backstrap member, and a plurality of coils wound on said pair of core members.

3. The electromagnetic device as defined in claim 1, wherein said spring biased armature is a flat magnetic member having a forward extending portion for accommodating an adjustable spring assembly.

4. The electromagnetic device as defined in claim 3, wherein said unitary metallic frame includes a pair of upstanding legs for attachment to said U-shaped electromagnet and includes a forward extending portion which underlies the forward extending portion of said spring biased armature.

5. The electromagnetic device as defined in claim 1, wherein said U-shaped electromagnet includes a pair of core pins having one end attached to a backstrap and having a pole piece formed on the other end, and a pair of insulative bobbins mounted on said core pins and having three separate coils wound thereon.

6. The electromagnetic device as defined in claim 3, wherein said adjustable spring assembly includes a threaded stem attached to said unitary metallic frame and extending through a hole formed in said armature, a helical spring and retaining cup fitted over said threaded stem, and a nut screwed onto said threaded stem and placing said helical spring in compression.

7. The electromagnetic device as defined in claim 1, wherein said apertured portion includes a pair of entrapping portions communicating with a pair of slots formed in the sides near the back end of said spring biased armature, and the top of said spring biased armature communicates with a top edge of said apertured portion to form a pivotal axis.

8. The electromagnetic device as defined in claim 1, wherein a pair of restraining tabs extending from the bottom edge of said apertured portion for holding said armature in place during assembly.

9. The electromagnetic device as defined in claim 1, said fulcrum point includes an upstanding tab stamped from the bottom of said unitary frame to engage the bottom surface of said spring biased armature to form a teeter-totter action.

10. The electromagnetic device as defined in claim 1, wherein said unitary metallic frame is stamped from a single piece of brass.

* * * * *